United States Patent [19]

Claessen

[11] Patent Number: 4,998,190

[45] Date of Patent: Mar. 5, 1991

[54] ARRANGEMENT FOR AN ATTACHMENT FOR AN ELECTRICAL DEVICE

[76] Inventor: Hans Claessen, Habsburgstrasse 17, CH-6045 Meggen, Switzerland

[21] Appl. No.: 364,440

[22] PCT Filed: Dec. 1, 1987

[86] PCT No.: PCT/SE87/00570

§ 371 Date: Jun. 26, 1988

§ 102(e) Date: Jun. 26, 1988

[87] PCT Pub. No.: WO88/04483

PCT Pub. Date: Jun. 16, 1988

[30] Foreign Application Priority Data

Dec. 5, 1986 [SE] Sweden ..... 8605229

[51] Int. Cl.[5] ..... E21V 7/00

[52] U.S. Cl. ..... 362/306; 362/391; 362/457; 439/682; 439/699

[58] Field of Search ..... 362/226, 433, 457, 458, 362/257, 306, 391, 396; 439/682, 699; 313/318

[56] References Cited

U.S. PATENT DOCUMENTS

| | | | |
|---|---|---|---|
| 262,420 | 8/1882 | Irwin | 439/682 |
| 2,276,559 | 3/1942 | Bashore | 362/391 |
| 3,231,731 | 1/1966 | McDonald | 362/226 |
| 4,298,919 | 11/1981 | Karasawa | 362/391 |
| 4,319,796 | 3/1982 | Wiley | 439/374 |
| 4,422,136 | 12/1983 | Newman et al. | 362/306 |
| 4,803,396 | 2/2989 | Kelner | 313/318 |

FOREIGN PATENT DOCUMENTS

| | | | |
|---|---|---|---|
| 2454050 | 12/1980 | France | 362/306 |
| 1422112 | 1/1976 | United Kingdom | 362/306 |

*Primary Examiner*—Stephen F. Husar
*Assistant Examiner*—D. M. Cox
*Attorney, Agent, or Firm*—Dvorak and Traub

[57] ABSTRACT

Arrangement for an attachment for an electrical device, such as a reflector fitted with a bulb, which exhibits in the form of a pin or similar an electrical connection capable of being pushed into an electrical junction. The invention permits, among other things, the simple and effective attachment of an electrical device to an electrical cable. A coupling capable of being joined to an electrical cable, which coupling exhibits appropriate electrical connection devices which fit the electrical connection in question, is so arranged as to function as a stop both for an electrical device and for a holder capable of being joined to the electrical device.

3 Claims, 1 Drawing Sheet

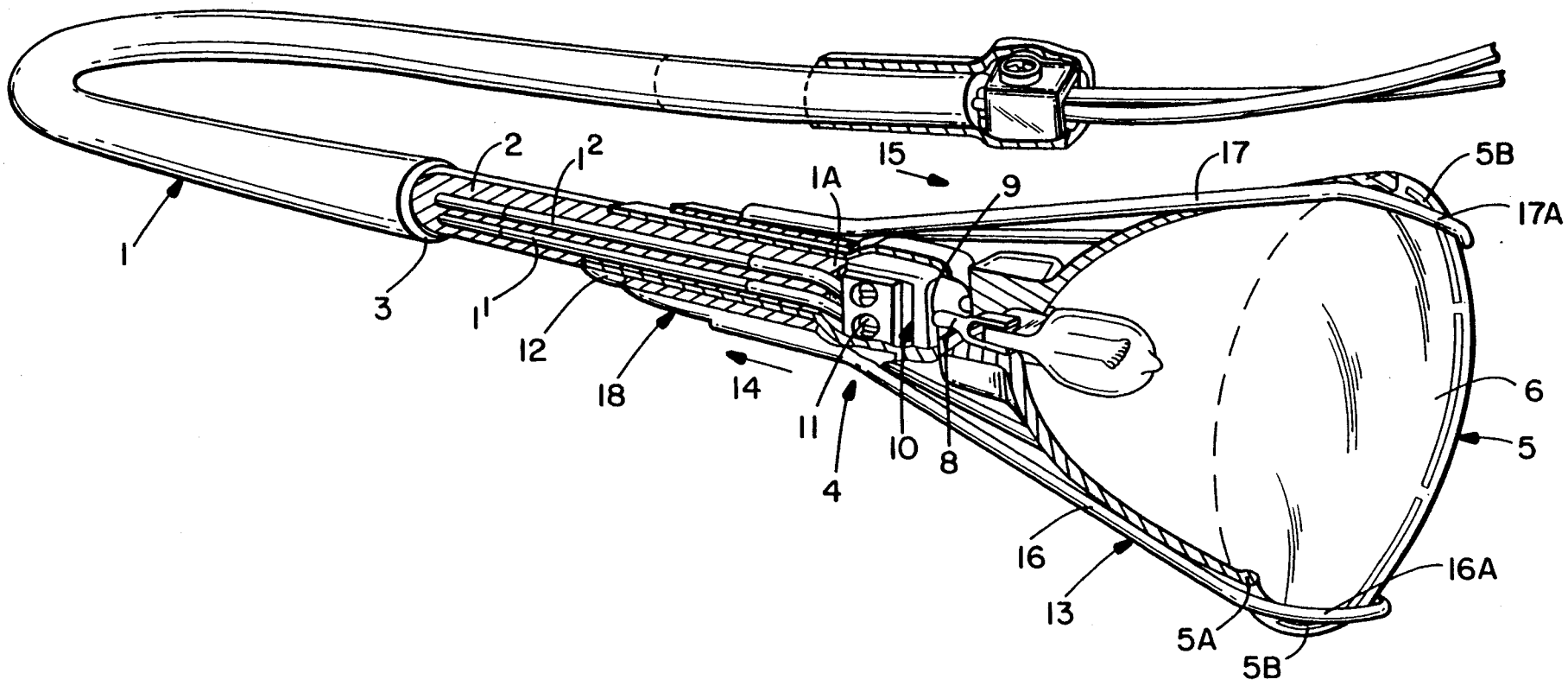
17A
5B
6
5
16A
5B
5A
17
13
16
9
8
15
10
1A
11
4
14
18
12
2
12
1
3
1

ARRANGEMENT FOR AN ATTACHMENT FOR AN ELECTRICAL DEVICE

The present invention relates to an arrangement for an attachment for an electrical device, such as a reflector fitted with a bulb, which exhibits in the form of a pin or similar an electrical connection capable of being pushed into an electrical junction.

The principal object of the present invention is, in the first place, to make available an arrangement of the kind indicated above, which permits a reflector fitted with a bulb or some other appropriate electrical device to be attached effectively and by simple means to an electrical cable in a separable fashion.

Said object is achieved by means of an arrangement in accordance with the present invention, which is characterized essentially in that a coupling capable of being joined to an electrical cable, which coupling is in the form of a component attached to one end of the electrical cable in question by means of, for example, a screw or some other fastening device and provided with an electrical junction with the ability to conduct electricity, is so arranged as to function as a stop both for an electrical device and for a holder capable of being joined to the electrical device, in opposite directions.

The invention is described below as a preferred illustrative embodiment, in conjunction with which reference is made to the drawing, which shows a bulb and reflector connected together in a partially sectioned view.

At one end 1A of an electrical cable 1, which exhibits a number of conductors $1^1$, $1^2$ and which is preferably strengthened by a reinforcement 2 and is enclosed by a sheath 3, similar to a flexible conductor, for example, a fastening arrangement 4 for an electrical device 5 of an appropriate kind is capable of being connected to said electrical cable 1. In the preferred embodiment the electrical device 5 comprises a reflector 6 with an integral bulb 7, preferably a so-called halogen bulb. Said electrical device 5 exhibits a number of pins 8 or an electrical connection of similar form, which is capable of being pushed into contact with an appropriate electrical junction 9, for instance holes.

A coupling 10, which exhibits the ability to conduct electricity and is capable of being joined to an electrical cable 1 of the kind in question, for example by means of a screw 11 or some other appropriate fastening device which holds the electrical conductors $1^1$, $1^2$ securely in position on said part 10, exhibits said matching electrical junctions 9, so that the pins 8 of the bulb or other electrical connections can be joined to said electrical conductors $1^1$, $1^2$ for the purpose of joining them to one another so that the bulb 7, etc., can be connected electrically so as to make contact in order, for example, to be capable of being lit at the desired moment. A casing 12, preferably in the form of a plastic hose, which is so arranged as to be shrunk by means of heat onto the electrical cable 1 and the coupling 10 so that it covers at least a part of them, may be so arranged as to protect them from contact and against being contaminated with dirt, and from damp, etc.

A holder 13 of an appropriate kind, which is capable of being joined to the electrical device 5, is so arranged as to be pushed against the coupling 10 at the same time as the electrical device 5 is pushed by the holder 13 in the direction of the coupling 10, in conjunction with which said coupling 10 is so arranged as to function as a stop both for the holder 13 and for the electrical device 5, although in opposite directions 14 and 15, so that the electrical device 5, at the same time as it is effectively restrained, is also capable of being pushed securely home so as to make good electrical contact. The holder 13 can comprise one or more sprung tensioning elements 16, 17 attached to the electrical cable 1, which are so arranged as to grip around the electrical device 5, preferably at a conveniently thickened peripheral edge 5A of same. Said tensioning elements 16, 17, which may consist of wire-like loops originating from a common and preferably divisible sleeve 18 or some other sleeve-shaped attachment which is able to grip around the electrical cable 1, exhibit a holder part 16A, 17A which is preferably wire-shaped and line-shaped, so that it can be snapped over and securely tightened against a segment-shaped part 58 of the preferably circle-shaped reflector 6 or some other appropriate electrical device 5.

The two loops 16, 17, the length of which is so adapted that they are able to be snapped over the peripheral edge 5A of the reflector, etc. 6, when the sleeve-shaped attachment 18 is displaced towards its front end position and is pushed against the coupling 10, as shown in the drawing, endeavour to force the reflector 6 with its associated bulb 7 and the electrical connections 8 in the direction of said coupling 10, so that the capacity of making good electrical contact is achieved at the same time as the electrical components are held together.

An attachment element of a previously disclosed kind may be arranged on the cable 1 at its end 1A facing away from the attachment for the electrical device 5 in order to permit the cable 1 supporting the bulb 7 and the reflector 6, etc., to be attached at an appropriate position, so that the cable 1 can be bent to a suitable shape to enable it to be directed towards a desired point of illumination, for instance.

The invention is not restricted to the illustrative embodiment described above and shown in the drawing, but may be modified within the scope of the Patent Claims without departing from the idea of the invention.

What is claimed:

1. An arrangement for the attachment of an electrical device, comprising:

an electrical cable, a reflector, a bulb disposed in said reflector, an electrical connection means for receiving said bulb, an electrical junction for receiving said electrical connection means, a coupling component having an electrical junction attachable to an end of said cable, a plastic hose casing covering a portion of said coupling and a portion of said electrical cable, said casing being shrunk fit around said coupling and said cable, a sleeve disposed around said cable, and a plurality of tensioning elements disposed on said sleeve such that, upon movement of said sleeve along said cable, said tensioning elements grip said reflector and simultaneously force said bulb and said electrical connection means against said coupling component, said coupling component disposed so as to limit the movement of said reflector as said sleeve is moved along said cable.

2. An arrangement for the attachment of an electrical device, comprising:

an electrical cable, a reflector, a bulb disposed in said reflector, an electrical connection means for receiving said bulb, an electrical junction for receiving said electrical connection means, a coupling component having a side facing said cable, and an electrical junction attachable to an end of said cable, a sleeve disposed around said cable, said sleeve disposed on the side of said coupling component facing said cable, a plurality of tensioning elements disposed on said sleeve such that, upon movement of said sleeve along said cable, said tensioning elements grip said reflector and simultaneously force said bulb and said electrical connection means against said coupling component, said coupling component disposed so as to limit the movement of said reflector as said sleeve is moved along said cable, and a holder disposed on at least one of said tensioning elements, said holder having a plurality of loops originating from said sleeve and extending out around said reflector, so as to grip said reflector.

3. An arrangement according to claim 2, wherein said holder comprises a wire.

* * * * *